US006766619B1

(12) United States Patent
Franz

(10) Patent No.: US 6,766,619 B1
(45) Date of Patent: Jul. 27, 2004

(54) KIT OF STRUCTURAL BUILDING PARTS

(76) Inventor: Viktor-Martin Franz, Rheinvorlandstrasse 10, 68159 Mannheim (DE)

( * ) Notice: Subject to any disclaimer, the term of this patent is extended or adjusted under 35 U.S.C. 154(b) by 0 days.

(21) Appl. No.: 09/979,239

(22) PCT Filed: May 21, 1999

(86) PCT No.: PCT/GB99/01616

§ 371 (c)(1),
(2), (4) Date: May 1, 2002

(87) PCT Pub. No.: WO00/71824

PCT Pub. Date: Nov. 30, 2000

(51) Int. Cl.[7] ..... E04B 1/344

(52) U.S. Cl. ..... 52/79.5; 52/66; 52/79.4; 52/143

(58) Field of Search ..... 52/66, 69, 71, 52/79.4, 79.5, 143

(56) References Cited

U.S. PATENT DOCUMENTS

| | | | | | |
|---|---|---|---|---|---|
| 311,245 | A | * | 1/1885 | Henn | 49/41 |
| 2,793,067 | A | | 5/1957 | Couse | |
| 3,460,297 | A | * | 8/1969 | Fritz | 52/66 |
| 3,534,997 | A | * | 10/1970 | Mitchell, Jr. | 296/176 |
| 3,617,086 | A | * | 11/1971 | King et al. | 296/172 |
| 3,714,746 | A | * | 2/1973 | Barlow | 52/69 |
| 4,660,332 | A | | 4/1987 | Colvin, Jr. | |
| 5,566,514 | A | * | 10/1996 | Freller | 52/79.5 |
| 5,661,930 | A | | 9/1997 | Porter | |
| 5,950,372 | A | * | 9/1999 | Al-Sabah et al. | 52/66 |
| 2003/0089070 | A1 | * | 5/2003 | Wall | 52/741.1 |

FOREIGN PATENT DOCUMENTS

| | | |
|---|---|---|
| DE | 196 31 647 A1 | 2/1998 |
| GB | 1 345 823 | 2/1974 |
| GB | 1 428 001 | 3/1976 |

* cited by examiner

*Primary Examiner*—Brian E. Glessner
(74) *Attorney, Agent, or Firm*—Burns, Doane, Swecker & Mathis, L.L.P.

(57) ABSTRACT

The invention provides a kit of structural building elements for rapid erection and assembly to form a living space having a ridged roof, wherein the elements (1, 2) are linked together and comprise a central prism-like element (1) and corresponding outer elements (2), said elements being arranged so that in a first state, suitable for transportation, they form an essentially cuboid structure having overall dimensions not equivalent to those of a standard 40 foot freight container and, in a end, erected state, the outer parts are raised to form a roof ridge line (3). Erection of a prefabricated building using the kit of parts can be effected without the need for heavy lifting machinery by pushing the outer elements (2) inwardly so that they slide up the sloping faces of the prism like central part.

9 Claims, 19 Drawing Sheets

KIT OF STRUCTURAL BUILDING PARTS

BACKGROUND OF THE INVENTION

This invention relates to a kit of structural building elements which can be rapidly assembled to form a living or working space.

The growing demand for living space throughout the world, the migration of large sections of the population in particular in the "third world" due to economic causes, as well as a sudden need for living space at the time of natural catastrophes such as earthquakes and floods, have introduced greater interest in prefabricated house construction in recent decades. However, there has been an absence of satisfactory solutions for rapid provision of the living space requirements.

Emergency accommodation, able to be used in a modular system for marginal groups of industrial societies requiring help, largely correspond to the strictly cuboid shaped accommodation. Such structures are moved and erected more or less like metal container and also connected as such Wide-scale rejection of the aforedescribed container temporary accommodation has hitherto obviously largely prevented a related further development. Thus, at the present time, no economical developments for the needy of the "third world" and beyond are available. Internationally active industrial groups are therefore occupied for native collaborators in the "constructions in the open countryside" in the "third world" with their own developments, but which should not be disclosed to the public as quickly by way of architectural publications or the like.

OBJECTS AND SUMMARY

It is the object of the present invention to close the gap pointed out by offering very economical prefabricated houses for settlements in rural areas of the "third world", and in country areas to provide accommodation, e.g. for hunting, fishing and other recreational pursuits, using normal handling equipment in container ports and ships as well as in railway and road transport systems.

A major problem to which the present invention is directed is the provision of a building system which is capable of being erected and assembled rapidly on a site to produce an adaptable living space but, at the same time, is readily transportable.

According to one aspect of the present invention there is provided a kit of structural building elements for rapid erection and assembly to form a living space having a ridged or pitched roof, wherein the elements are linked together and comprise a central prism-like element and corresponding outer elements, said elements being arranged so that in a first state, suitable for transportation, they form an essentially cuboid structure having an overall length not exceeding that of a standard 40 foot freight container and, in a second state, the outer parts are raised to form a roof ridge line.

Thus, in its simplest state, the present invention provides a group of three structural parts, a central prism-like element and a pair of outer parts, which nest with the central part in a first transportation mode, to form a cuboid assembly having overall dimensions which generally correspond to those of a standard, international freight container. Consequently, in its first mode, the structural parts can be readily handled and transported using normal handling equipment in container ports and ships.

In order to fit in nesting engagement with the prism-like part, the outer elements each have a generally trapezoidal shape with 6 faces, including a sloping face, which interfaces with one of the sloping side faces of the prism-like element, when the parts are in their transportation or storage mode.

In order to enable the elements to be erected quickly to form a living space with a pitched or ridge-like, roof line, the outer elements are linked by a hinge device at their inner apices and the prime-like inner element carries guides or rails on its sloping faces. Consequently, when the two outer parts are pushed towards each other, they ride upwardly on the guides until their inner sloping faces come together. This movement is accommodated by pivoting of the outer elements about the hinge device. When viewed from one end, the three main structural parts fit together in the assembled state with a major joint in the form of an inverted Y at the lies of contact between the sloping inner faces of the outer parts and the interfaces between the sloping faces of the prism-like element and faces of the outer elements which form the bases in the transportation mode. This inverted Y-shaped joint line permits the assembled building to expand or contract in response to changing ambient temperatures without damaging the structure of the building. A mastic sealing compound can be introduced into the joint.

Advantages of the basic structural building system of the invention include the fact that the main walls and roof surfaces are formed directly from the basic elements and the parts nevertheless take up only the overall volume of a standard freight container. A building having a pitched or ridged roof is more attractive and practical since rain and snow runs off, rather than lying on the surface as is usual with flat roof structures. The structural building system is also advantageous in that the necessary height for a two-storey building is achieved in its erection, whereas conventional modular building systems require the placing of additional units on top of ground floor units.

Another advantage is the possibility of erecting One or two storey structures without the need for cranes of similar lifting equipment, the elements being capable of being erected by simple jacks.

Further features and advantages of the present invention will become apparent from the following detailed description and specific embodiments as shown in the accompanying drawings.

The embodiments of the invention lie within the limited framework of the external dimensions of cuboid-shaped 40 foot freight containers, such as are used in world-wide freight traffic, are illustrated in the drawings FIG. 1 to 19 and will be described in detail hereafter.

DESCRIPTION OF THE DRAWINGS

FIG. 18 shows three basic modular structures connected laterally, on prepared foundation points on a rising slope with stabs to the respective upper floors sketched-in.

DETAILED DESCRIPTION OF PREFERRED EMBODIMENTS

Figure 1:
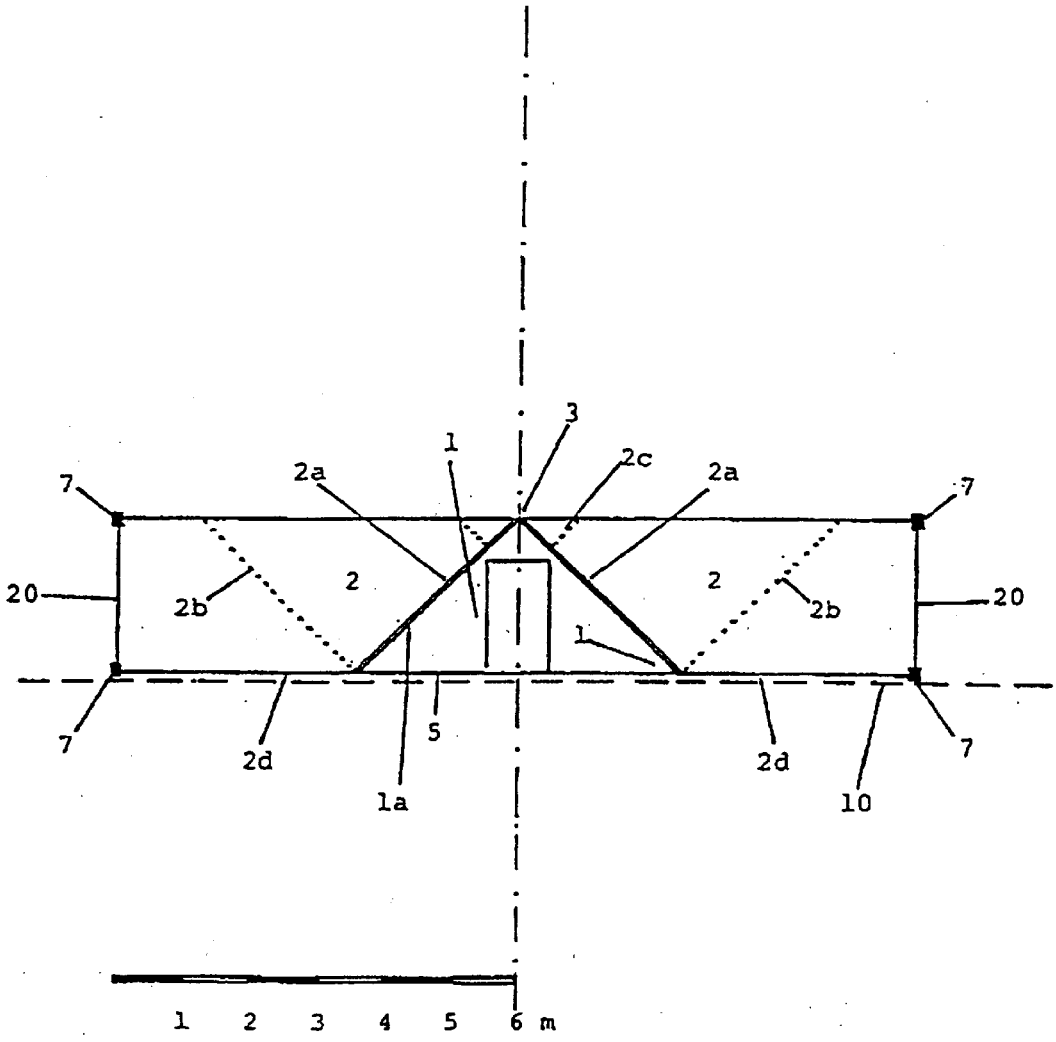
FIG. 1 is a front elevation of a kit of parts in transportation mode consisting of three interconnected three-dimensional elements.
Figure 2:
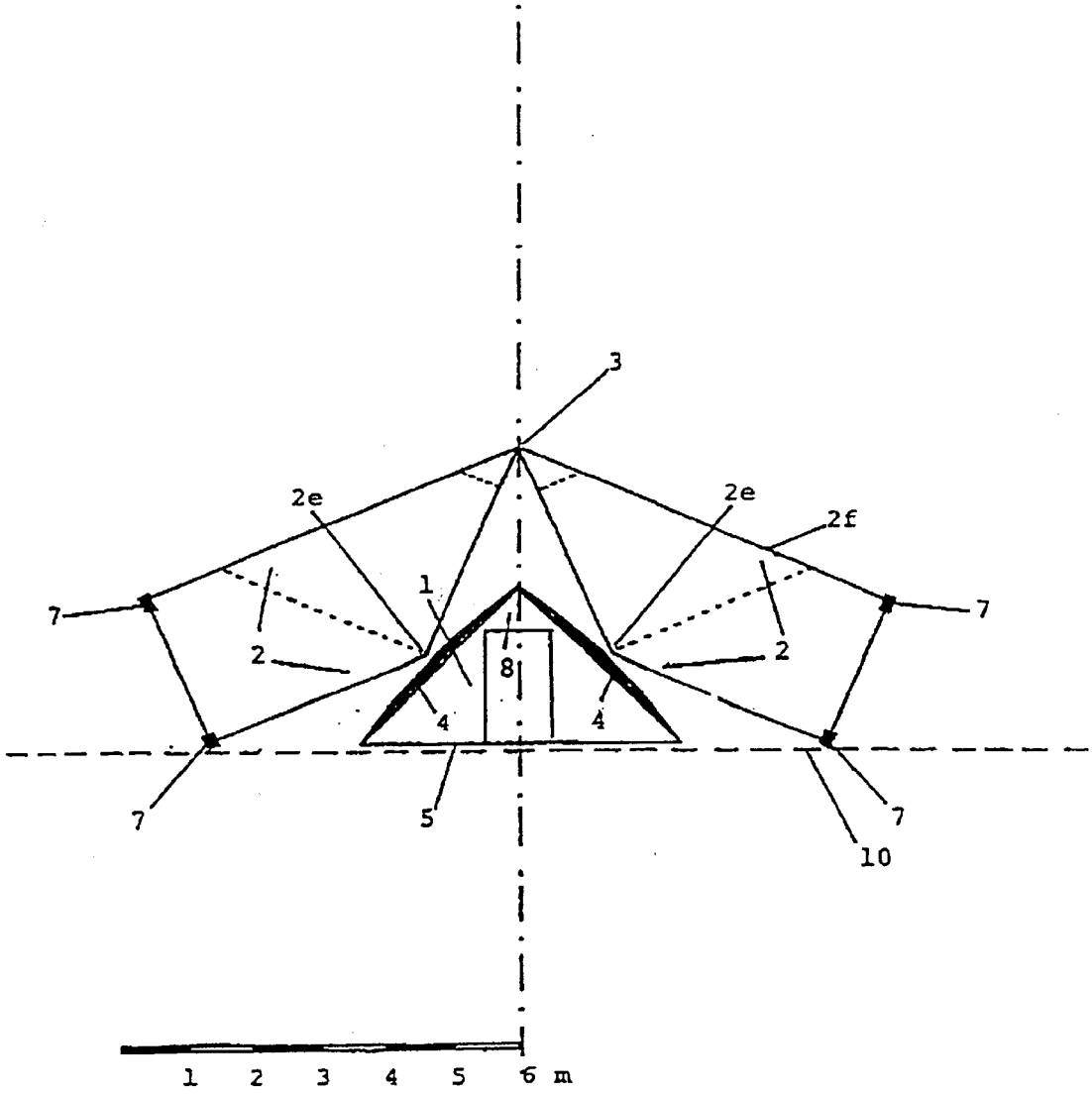
FIG. 2 shows an initial phase in the erection of the elements.
Figure 3:
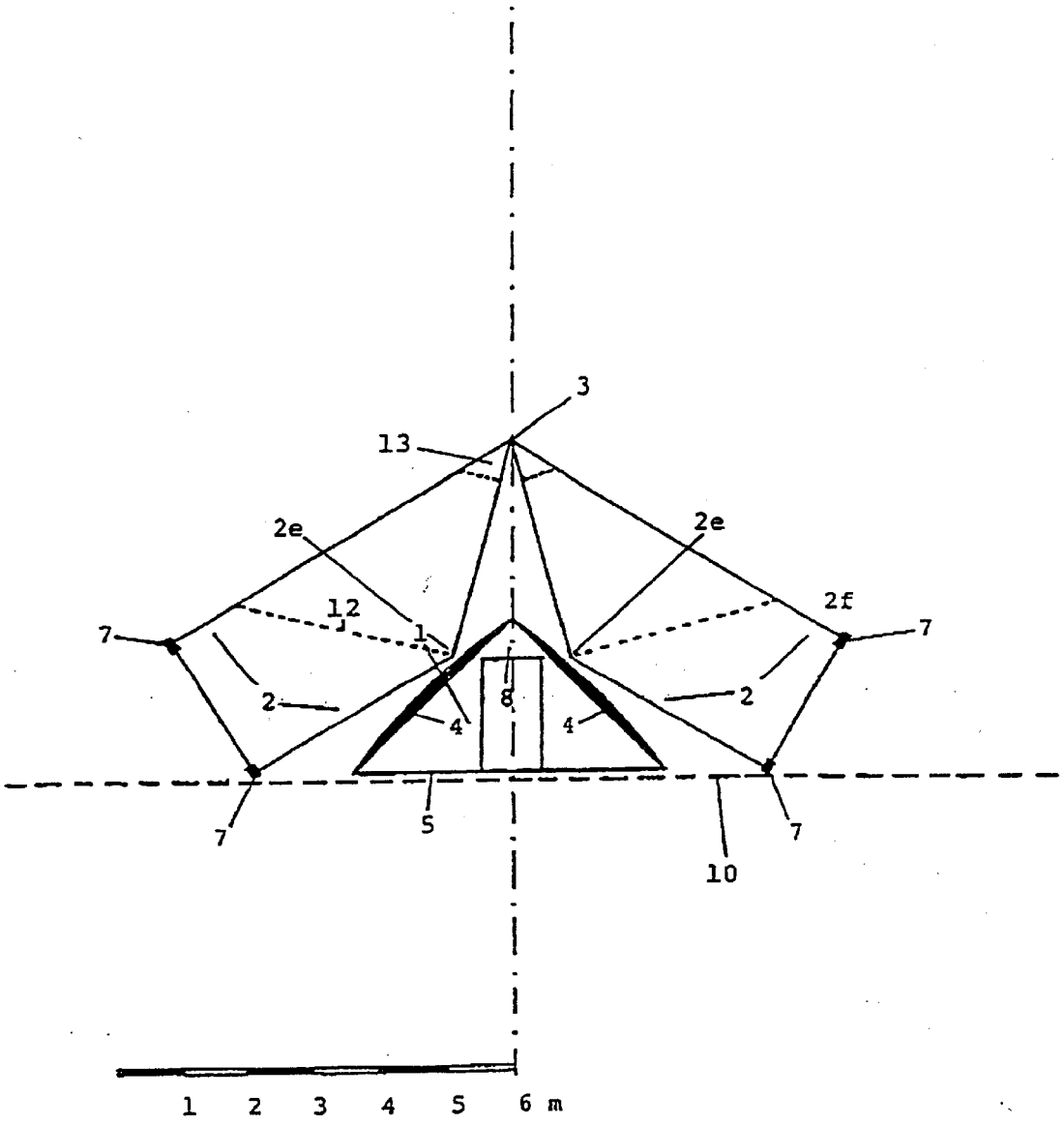
FIG. 3 shows a later stage in the erection of the same elements shown in FIGS. 1 and 2.
Figure 4:
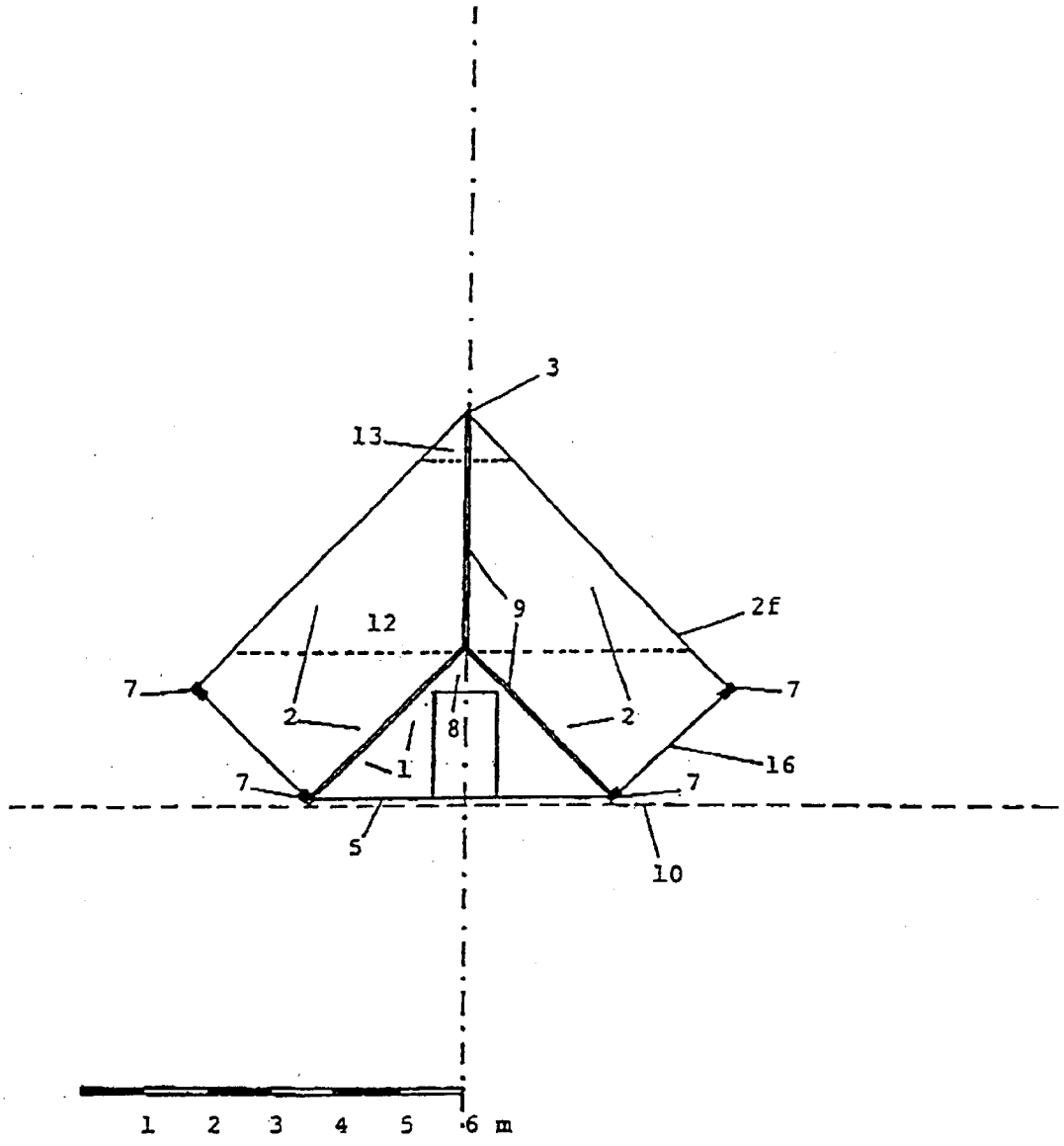
FIG. 4 shows the structural elements of FIGS. 1 to 3 in their fully erected mode.

Referring to the accompanying drawings and, in particular, FIGS. 1 to 4, a kit of parts is shown in FIG. 1 in their transportation mode suitable for assembly into an erected basic modular building unit as shown in FIG. 4. The basic kit comprises a prism- or wedge-shaped central element (1), which in section is an isosceles triangle, although the sides need not be equal. A pair of outer elements (2) are essentially trapezoidal in shape and have sloping inner faces (2*a*) which nest together adjacent to sloping faces (1*a*) of the prism-like element (1) in the transportation mode shown in FIG. 1. Elements (2) may incorporate pre-installed floors and ceilings (2*b*) and (2*c*) of the erected unit shown in FIG. 4.

In the mode shown in FIG. 1, the overall dimensions from the points of view of the over length and depth correspond to the dimensions of a standard international freight container. This is 40 feet in length and about 8.5 feet deep. The standard height is also about 8.5 feet but there is some variation in height permit by container shippers and handlers. It may, therefore, be possible to increase the height of the structural elements without prejudicing their acceptance for transportation.

Elements (2) are connected at their apices by a hinge device (3) to permit the two parts to pivot as they are raised, as shown in FIGS. 2 and 3. The apices of the elements (2) are coincident with each other and with the apex of the prism-like element in their transportation mode. However, the faces (1*a*) of the prism-like element carries guides or rails (4) on which the outer elements (2) can ride to permit the outer elements to be erected on the prism-like element. Rails (4) may have a convex or parabolic form and obviously are constructed to be strong enough to support the weight of the elements (2). To permit the outer elements (2) to ride more easily on the rails (4), the elements (2) may be equipped with wheels or sliding shoes, especially at the carrier points (2*c*)—see FIGS. 2 and 3. Outer elements (2) are provided with strengthening comer pieces, which may be castings or forgings (7) similar to those used in standard transport containers.

Erection of the basic modular unit is achieved by pushing the outer elements (2) inwardly as shown in FIGS. 2 and 3 until the elements come together in the juxta-position shown in FIG. 4. This may be achieved, for example, by using hydraulic or mechanical jacks which are arranged to act between the end wall (16) of the elements (2) and an anchor point or points. The anchor point or points may comprise a rail laid along the line (10) (see FIG. 4). In the erected mode shown in FIG. 4, the faces (2*a*) of the outer elements are in contact (or dirty adjacent) and base faces (2*d*) of the outer elements are adjacent to the sloping faces (1*a*) of the prism-like element These adjacent faces form a gap (9) having the shape of an inverted Y when viewed in front elevation. This gap may be sealed and/or covered with a cladding material as part of the finishing operation.

Because the prism-like or wedge-shaped element (1) is required to withstand the weight of the outer elements (2) in the erecting operation, it is preferably strengthened. For example the element (1) may be provided with an internal reinforcing part (8). Part (8) may also support internal stairs (14) in the assembled building—see FIGS. 15 and 16.

In its state, the basic structure has the appearance shown in FIGS. 8, 12, 15 and 16. The building elements (1 & 2) may be delivered with internal fittings such as stairs, floors, doors and internal partitions and even bathroom or kitchen fitting or these may be fitted later. Also, the walls of the elements 1 and 2 may be pre-fitted with windows (18,19), (see FIGS. 13 and 14) which ray be protected with removable covers during transportation. Roof panels or wall sidings may be attached after assembly to improve the appearance or, in the case of roof panels, to seal off the hinge area (3) and to throw rain water clear of the walls of the building.

The amount of living or working space can be increased and a more elaborate building constructed by connecting together two or more modules of the basic unit. For example, FIGS. 5, 6, 9 and 10 show how three modular units can be bolted together front to back to produce a building having three times the depth of a standard international freight container.

Figure 7:
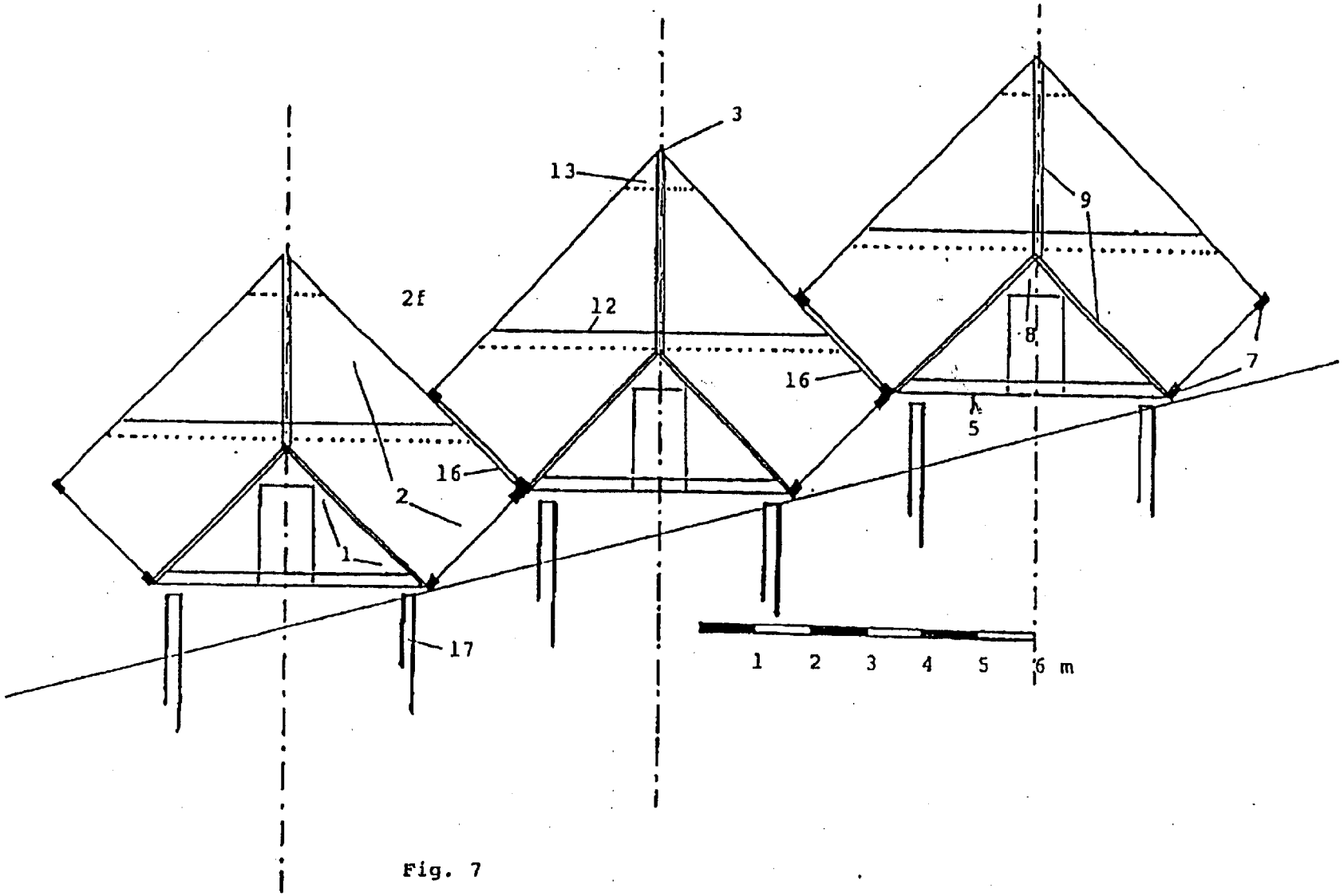
FIG. 7 shows three assembled basic modular structures erected on prepared foundation points on a rising slope and connected together laterally.

FIG. 7 shows an alternative arrangement in which three modular units are linked together side by side. In this case the end faces (16) of certain of the outer elements (2) are connected to the upper surface (2*f*) of an adjacent unit. The connecting together of several units in this way improves the structural rigidity of the whole building.

Figure 11:
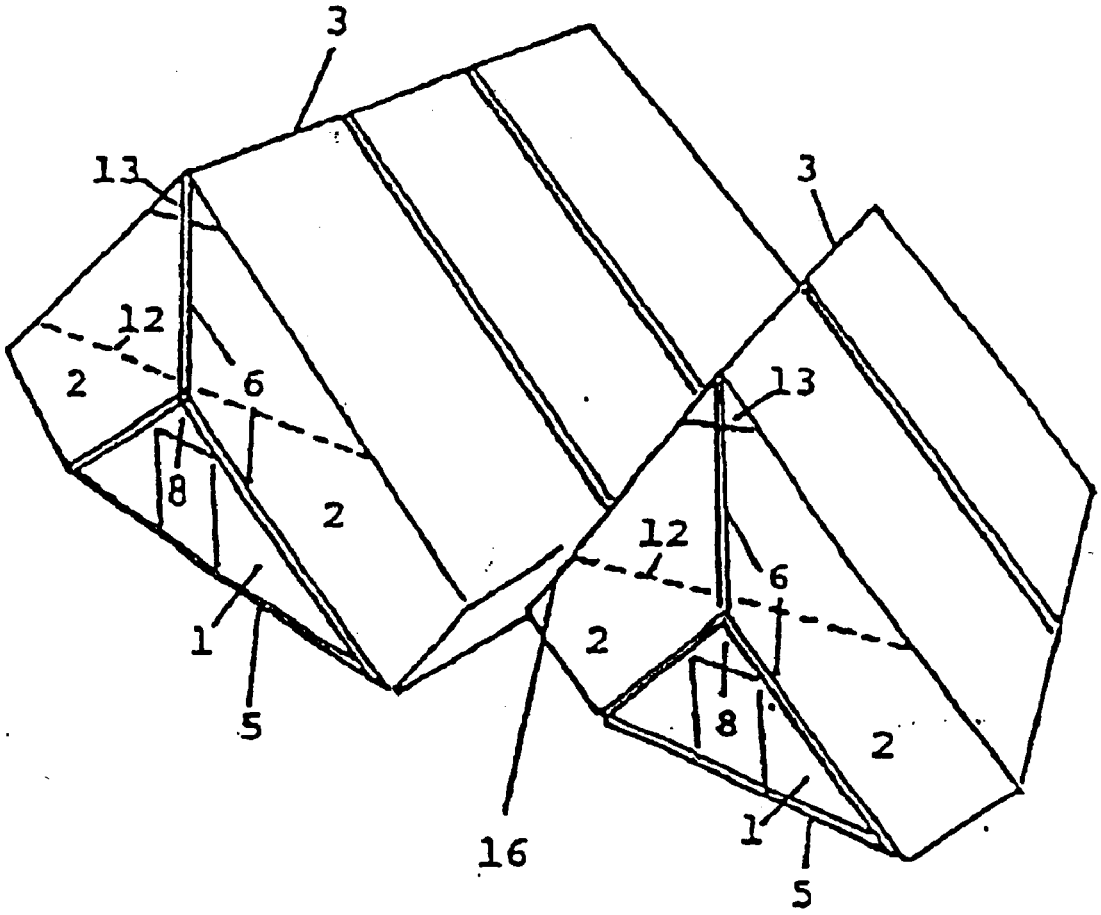
FIG. 11 shows in perspective view five erected and connected basic, modular erected structures.

FIG. 11 shows an alternative arrangement in which five modular units are linked together. In this case, three of the units are connected together front to back in a first group, while two further units are connected side to side with the first group.

Although the prefabricated building and kit of parts in accordance with the invention are primarily designed for emergency living accommodation, it will be appreciated that the buildings adoptable for other purposes, including offices and workshops.

The advantages achieved with the invention including the fact that the large structural parts in the kit are able to fit into the cuboid-shaped container transport system introduced world-wide. The kit may consist solely of three large individual parts connected to each other (e.g. the three-dimensional parts (1 & 2) shown in the drawings), so that when erecting the two larger three-dimensional parts (2) above the prismatoidal central part (1), any wall, roof and ceiling surface no longer have to be progressively swung up or down, raised or fitted together or inserted in some other way. The wight of the two large three-dimensional parts (2) hinge-connected at (3) in the region of the ridge (13), is supported at the time of erection over the base surface (5) on the building site with a simple spreading and clamping tools on special guide rails (4). The guide rails which are mounted on the legs (9) of the prismatoid-shaped central part (1) in the form of convex ascending arcs or parabolas. The geometric shape of the central part (1) could also be designed as a wedge, unless the bearing surface were to be observed for the positioning of the spreading tools bellow the later ridge (13) and the high degree of prefabrication of the large structural parts (1 & 2) for settlement prefabricated houses protected by a ridge roof corresponds to a single joint, i.e. hinge (3) in the ridge section (13), so that the two erected three-dimensional parts (2) above the central part, together with the latter on the gable front reveals solely a main joint system (6) comparable with an inverted Y. This makes an important contribution to sealing the construction with regard to driving rain, sand storms etc., whereby the high degree of prefabrication of the large structural parts (1 & 2), even in the case of the system-associated construction of the Y-shaped joint formation (6) of the facade sides=gable fronts allows the panorama window installation (19) with an increased introduction of sunlight, which is demanded increasingly frequently.

The advantages achieved by the invention, in comparison with the prior art with cuboid-shaped three-dimensional members, the so-called container structures, or new developments, in which settlement houses probably acquire a capacity for transportation in the international container freight traffic (20), but the construction takes place by way of gradual individual measures such as swinging down, unfolding, lifting, pushing etc., must be co-ordinated with the normal expectations of potential users.

Thus, in the individual case, a desirable greater square meter provision per settlement house can be achieved by way of a connection (11) and (16) of several standard large structural parts. Seen from a structural point of view, the individual large structural part is subject to the fixed dimensions of customary 40 foot freight containers (20), without in this case having the aforedescribed drawbacks of the cuboid-shaped living containers.

The special guide rails (4) with a convex ascending curved shape on the legs of the prismatoid-shaped central part 1 form for the period of transportation and storage of the individual large structural parts, also a connection (9) of the three three-dimensional parts (1) and (2) one to the other, which connection can be satisfactorily screwed or locked. Thus, questions of the transportation load-carrying capacity of the individual cuboid-shaped large structural part containers (20) when stacked multiply at harbour storage yards or on ships on the high sea, i.e. frequently pressures of 100 tonnes and above on the lower of containers—can remain without risk.

The installation of a reinforced frame 8 in the central part 1 of each large structural component absorbs the energy of impacts and compressive forces at the time of installation in situ even in less developed areas so extensively that obviously the construction mechanism and the desired high equipment standard (14) and (15) are not affected.

The installed reinforced frame (8) in the prismatoid-shaped central pad (1) is the basis for the installation of prefabricated stairs (14) leading to the upper floor (12), but also for the potential installation of sanitary and kitchen appliances (15).

Since, today, even in railway container traffic, one can already perceive excesses of the older maximum external dimensions, whilst maintaining the original dimensions for the loading devices, structural adaptations in order to achieve greater headroom and/or in the case of requirements for thicker thermal insulation layers, should be aforeseen.

Greater numbers of large structural parts of the sent invention to be loaded will also cause the haulage contractors to authorise special heights—such as are basically not refused for example today on North Atlantic traffic. In this case, the lateral external dimensions—thus the parallel distances between container walls and end faces with respect to each other remain untouched, the expensive loading crane installations as well as the numerous special heavy good vehicles and railway trucks throughout the world can even in the medium term to unmodified, quite apart from the ship's holds and storage areas on deck.

The following is a summary of the features of the invention which are shown in the drawings.

Figure 5:
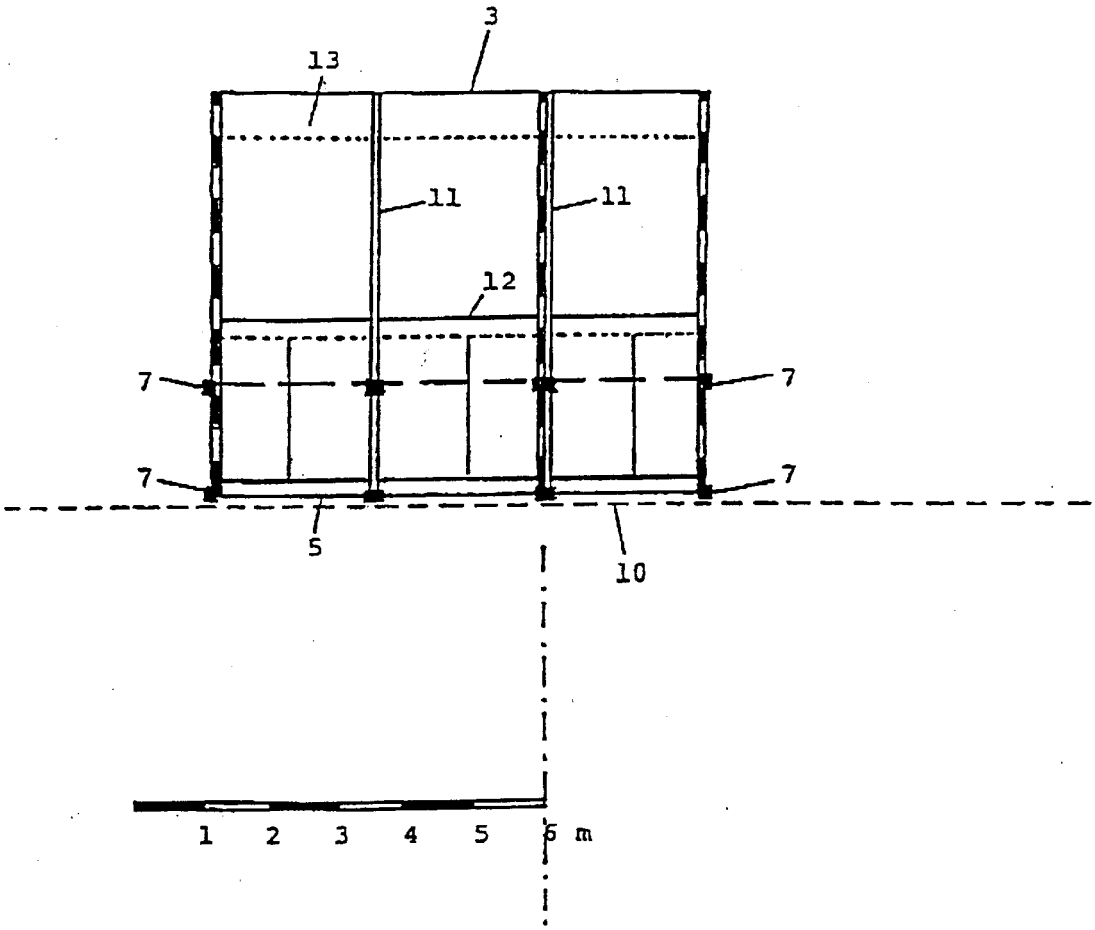
FIG. 5 is a side elevation of three erected structures which have been coupled together to form a living space having three times the depth of the basic erected modular unit of FIG. 4.
Figure 6:
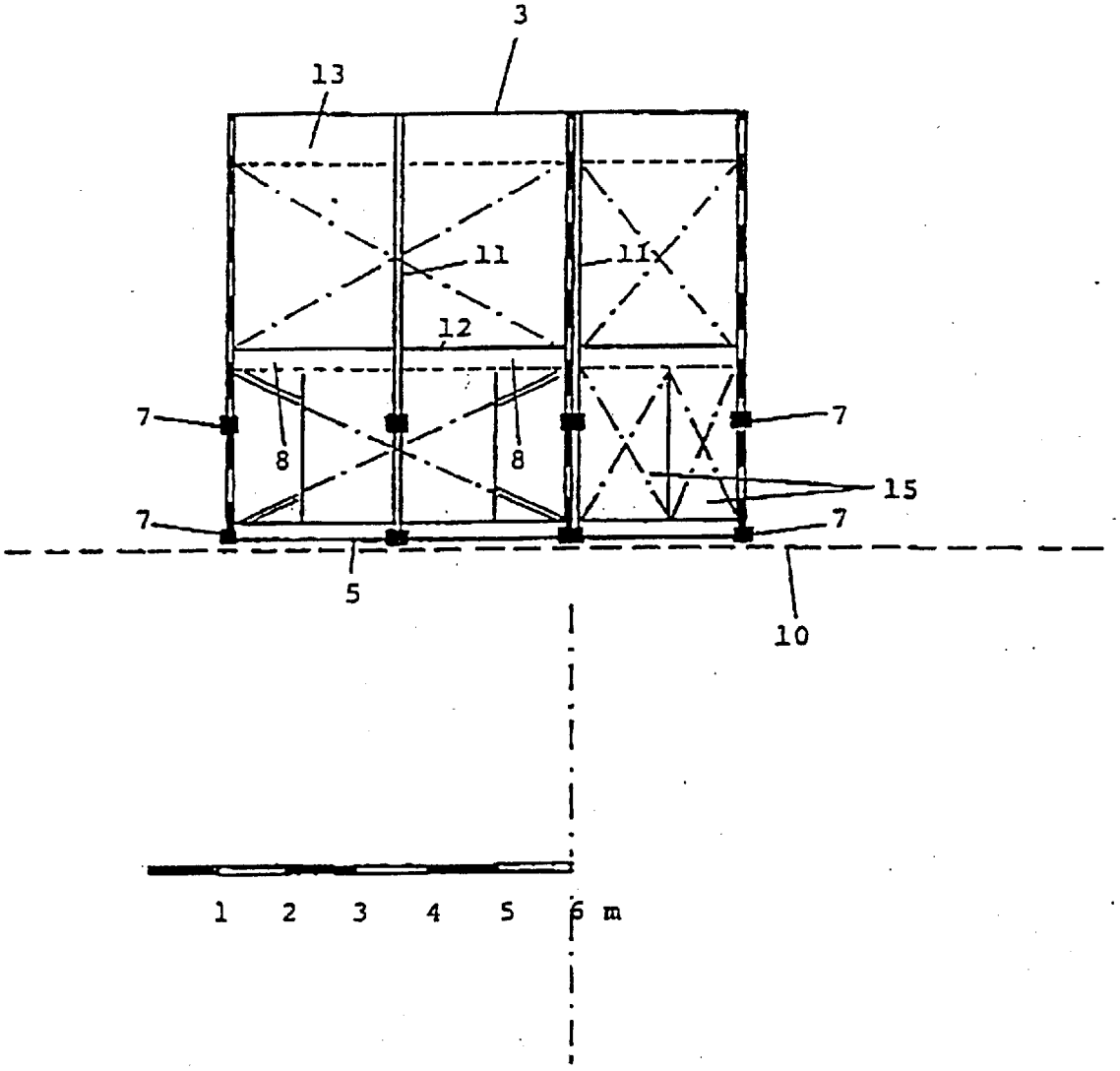
FIG. 6 is a view similar to FIG. 5 showing possible division of internal space.

FIG. 1 shows a transportable large structural part consisting of three interconnected three-dimensional parts in the form of a geometric cuboid=40 foot freight container, FIG. 2 shows a partial phase of the erection of the larger three-dimensional parts hinge-connected in the ridge region, above the prismatoidal central part;

FIG. 3 shows the partial phase of the erection of the larger three-dimensional parts, hinge-connected in the ridge region, with delivery of the load to the guide rails, which lie on the equal-sided legs of the central part and in order not to fall below the foundation base line at point 10, adopt a two-sided convex ascending curved shape on separate arcs or parabolas;

FIG. 4 shows the erected large structural part consisting of three interconnected three-dimensional parts with a view of the outer gable front with the two recognisable living planes;

FIG. 5 shows three erected large structural parts connected by way of the gable sides, with a standard basic construction seen from one back side;

FIG. 6 shows connected, erected large structural parts, seen from one back side, with possible division of space;

FIG. 7 shows large structural parts connected by way of the back sides, on prepared foundation points on a rising slope.

Figure 8:
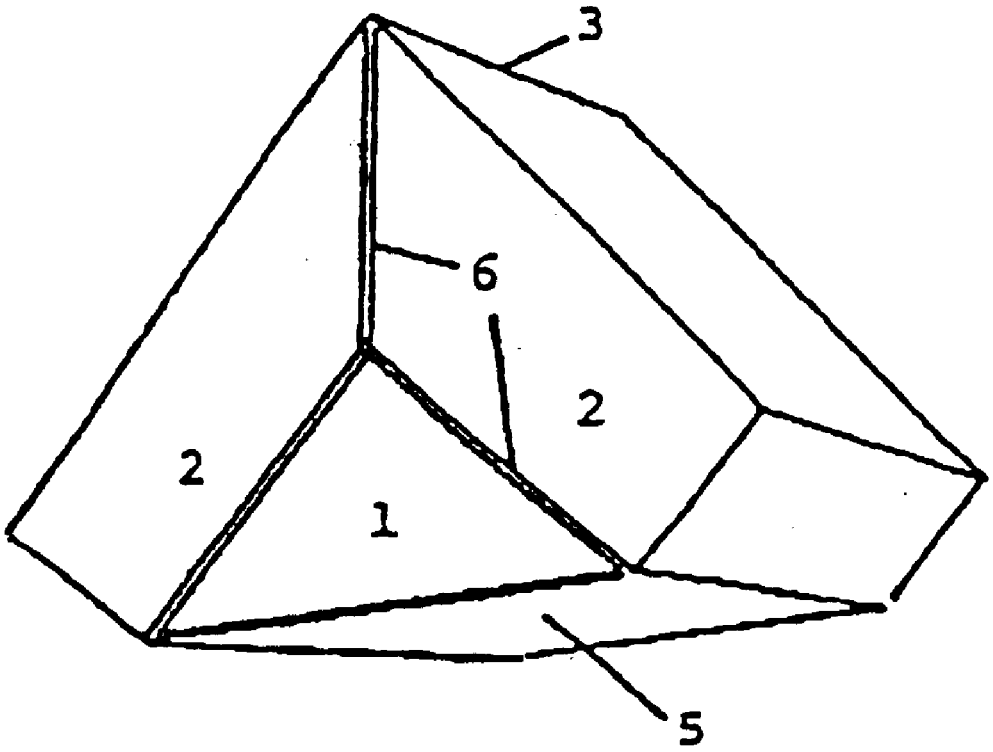
FIG. 8 is a perspective view of the basic, erected structure of FIG. 4.
Figure 9:
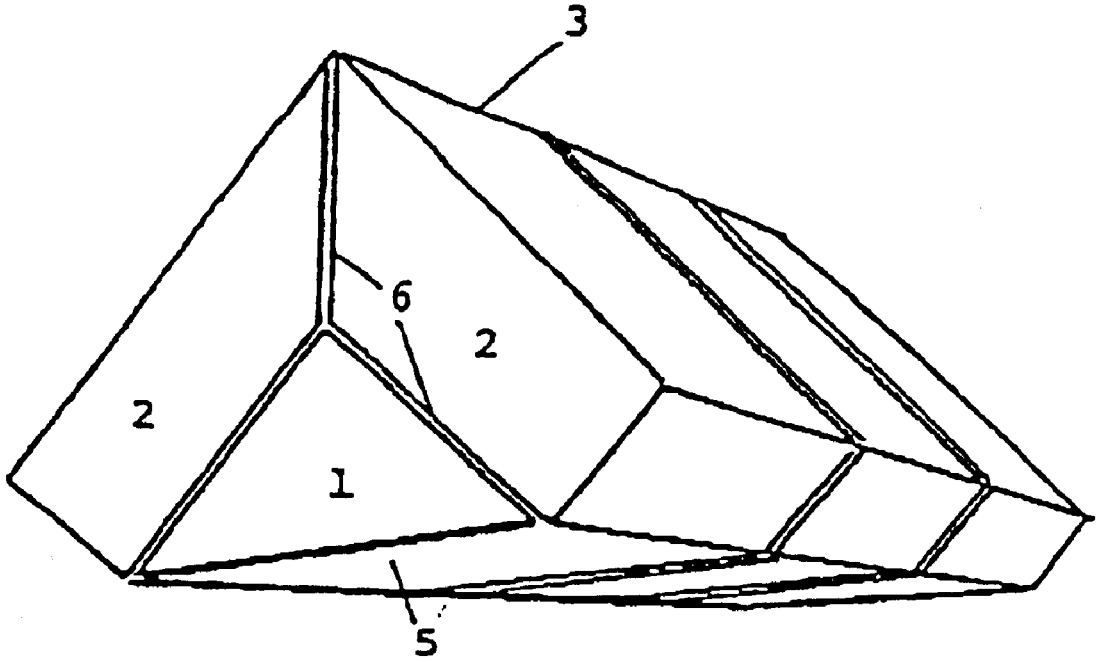
FIG. 9 shows in perspective view three erected, connected basic modular structures as shown in FIG. 5.
Figure 10:
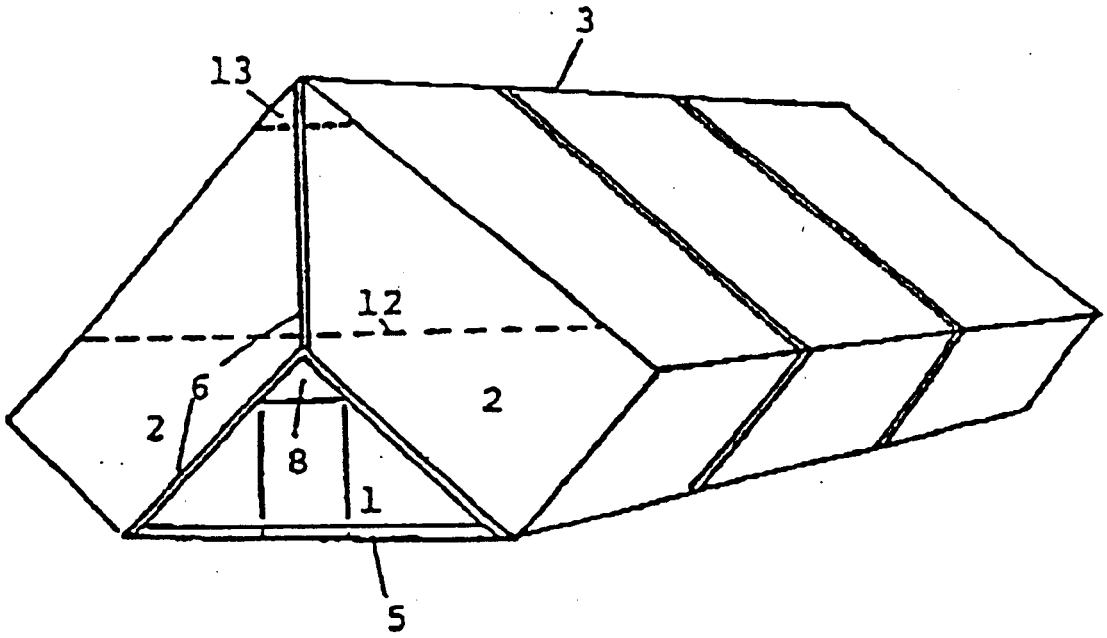
FIG. 10 is a view similar to FIG. 9, showing in broken lines the living space in the upper storey.
Figure 12:
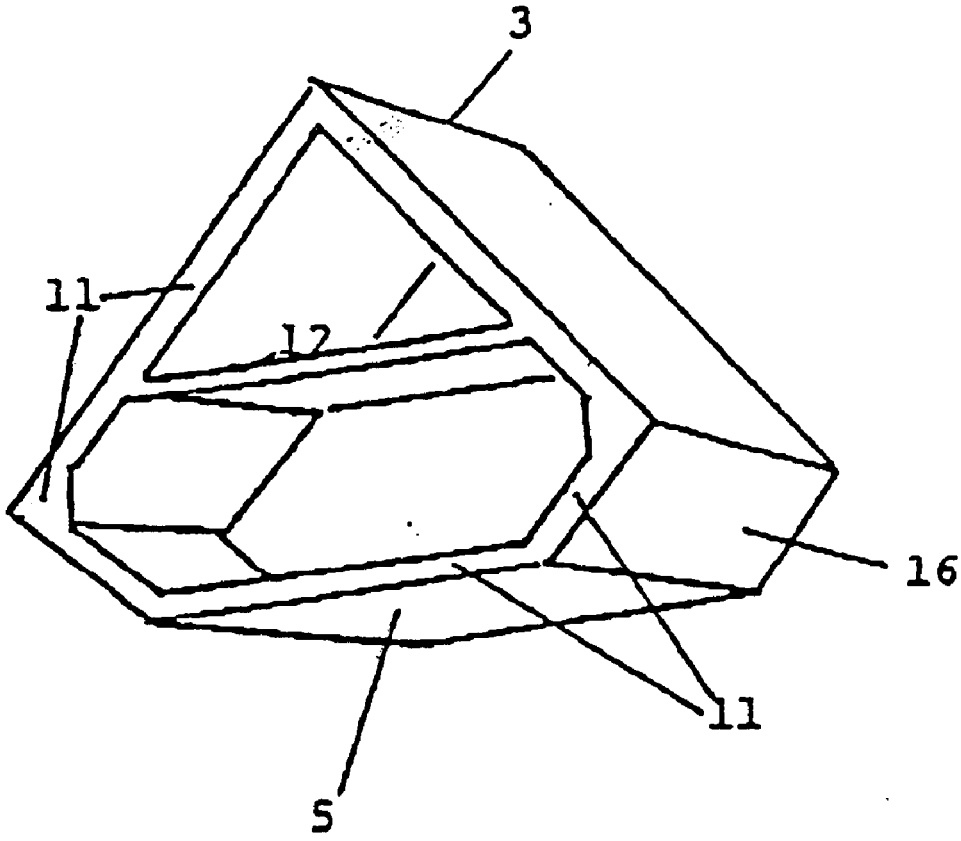
FIG. 12 is a schematic, perspective view of an erected basic modular structure ready for connection.
Figure 13:
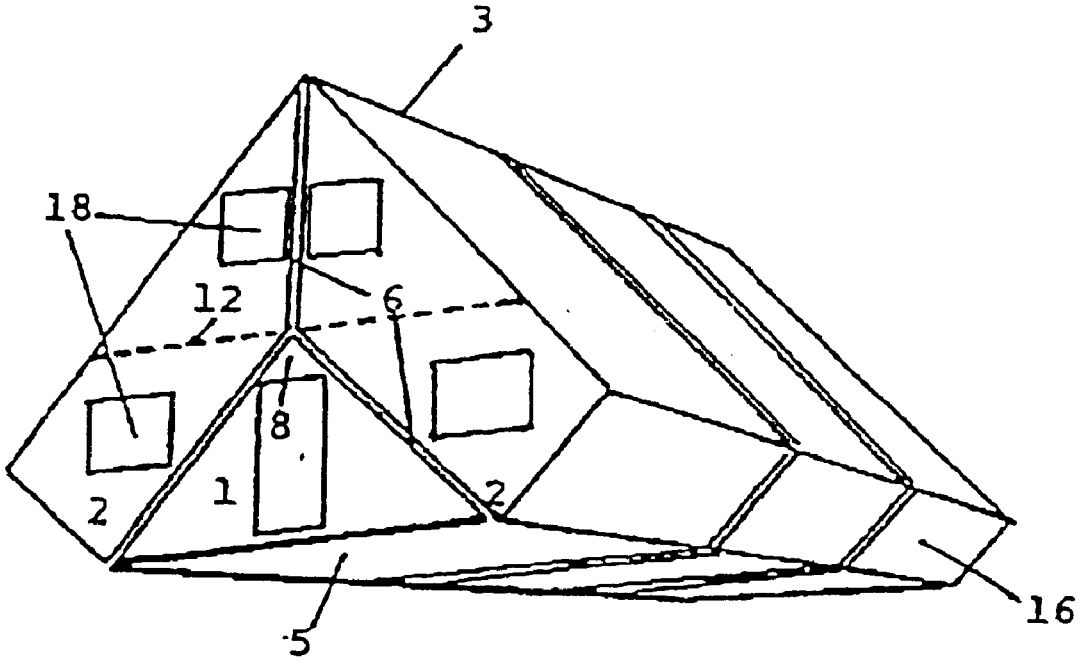
FIG. 13 is a perspective view showing a facade design of an erected prefabricated house consisting of three basic modular structures with conventional door and window members.
Figure 14:
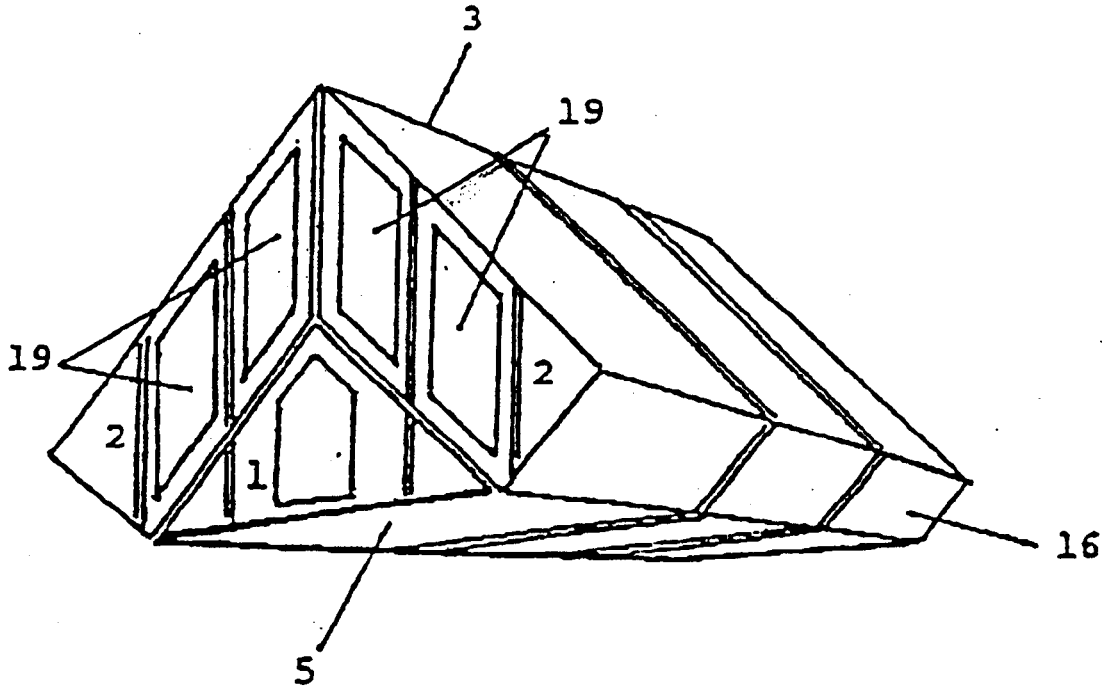
FIG. 14 is a perspective view of a facade design of an erected prefabricated house consisting of three basic modular structures with panorama window members extending over two living levels.
Figure 15:
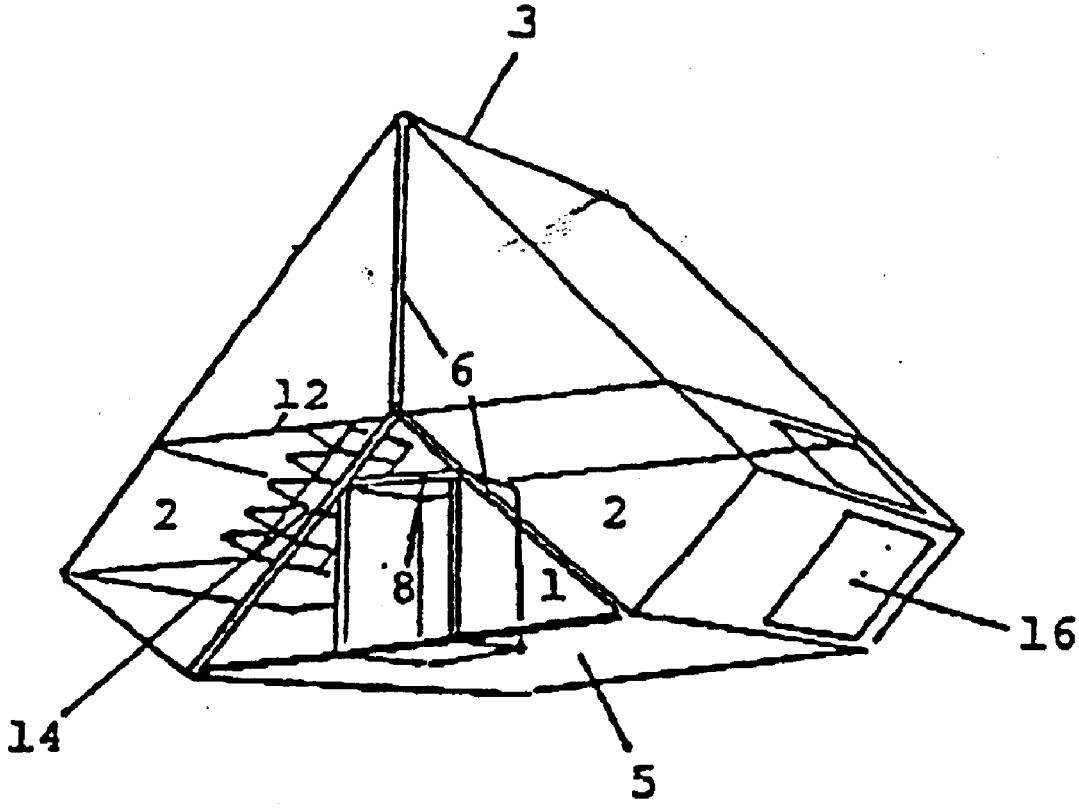
FIG. 15 is a perspective view from the entrance to the reinforced frame of the prism-like central part with the larger three-dimensional parts erected thereabove, including stairs as well as a passage for a connection on the back side.
Figure 16:
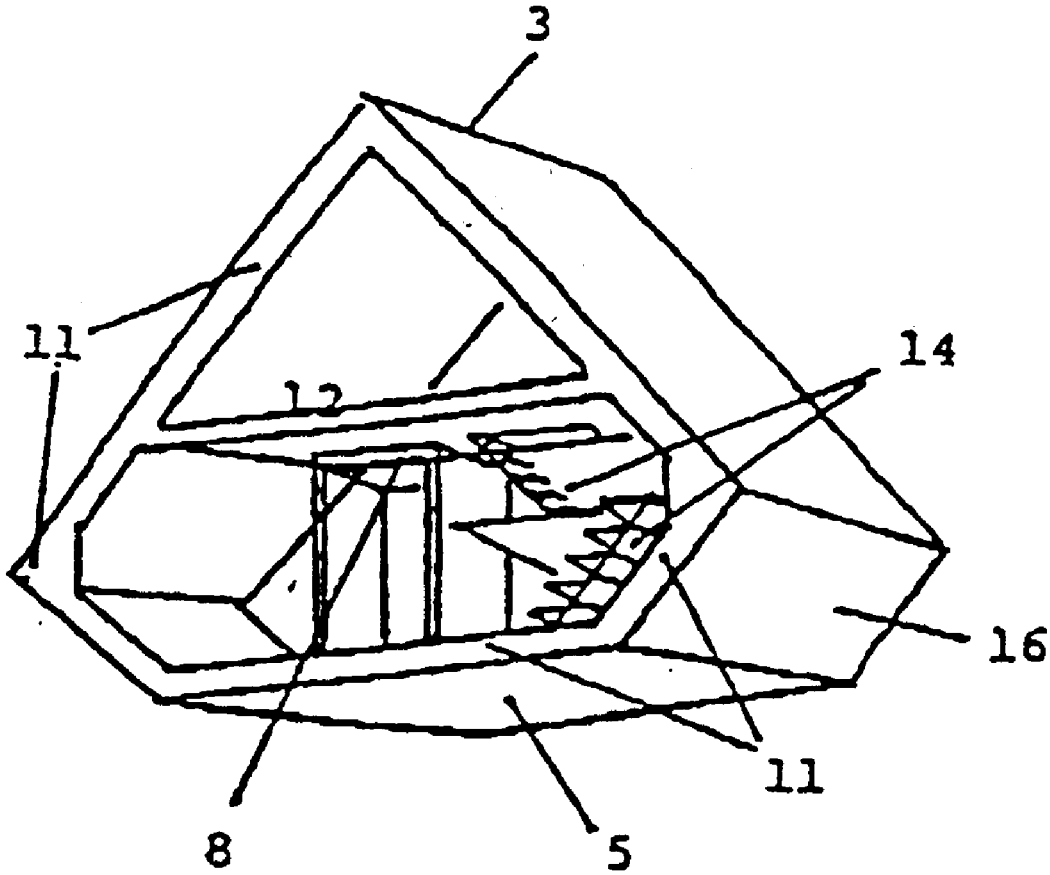
FIG. 16 is a perspective view similar to FIG. 15 with reinforced central part and built-in stairs.
Figure 17:
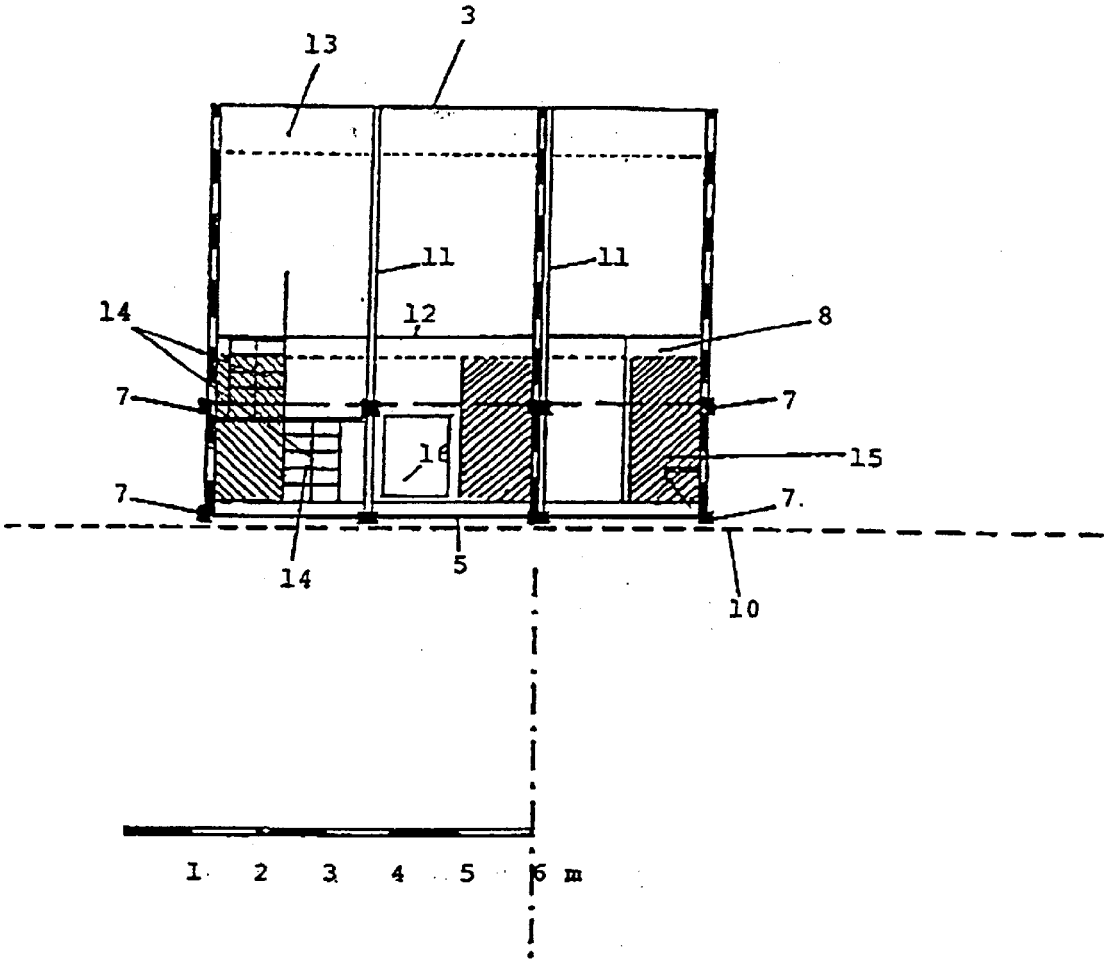
FIG. 17 shows three connected, modular structures, seen from one side, with incorporated stairs to the upper level, passage to the rear connection, as well as sanitary and kitchen fittings.
Figure 18:
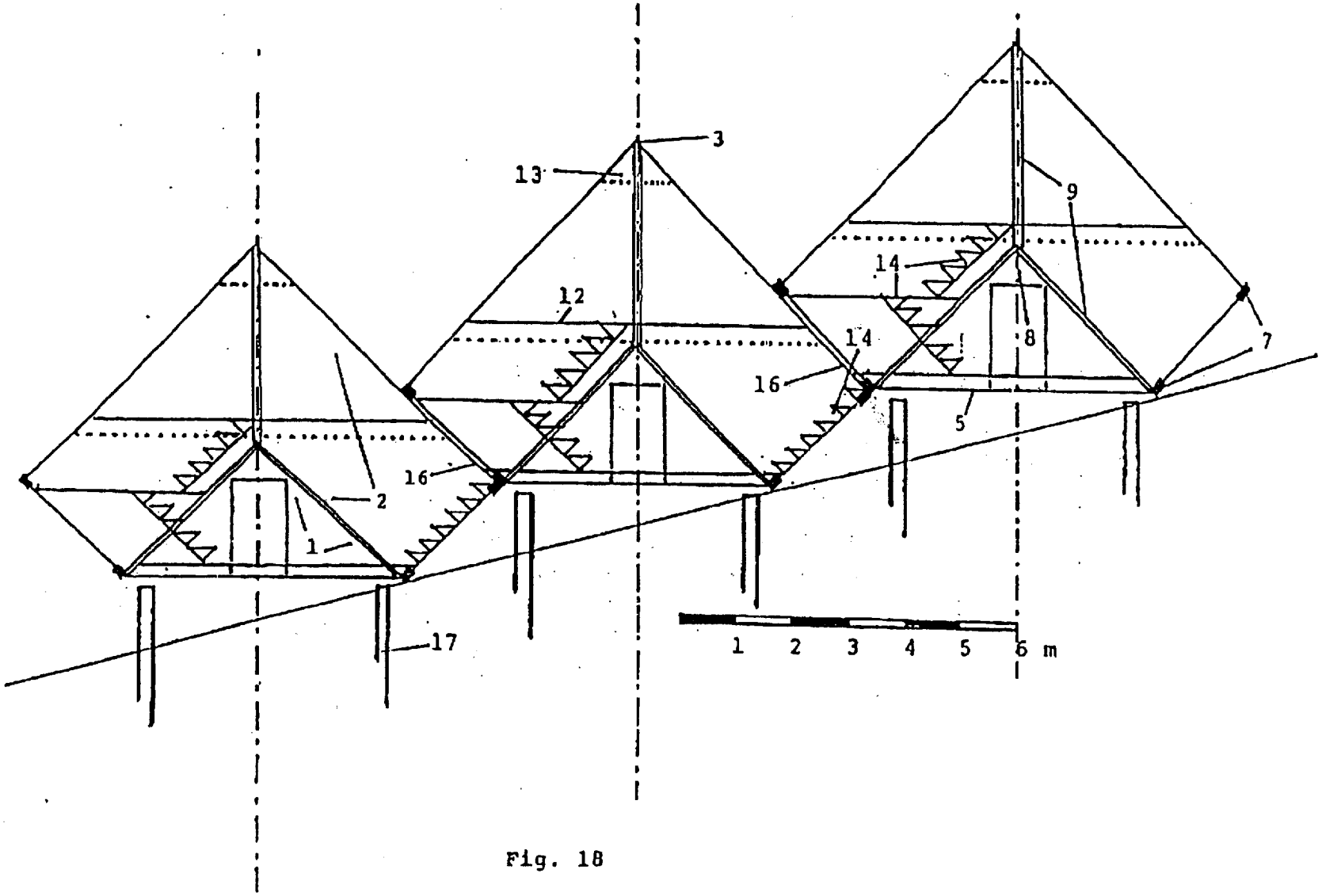
Figure 19:
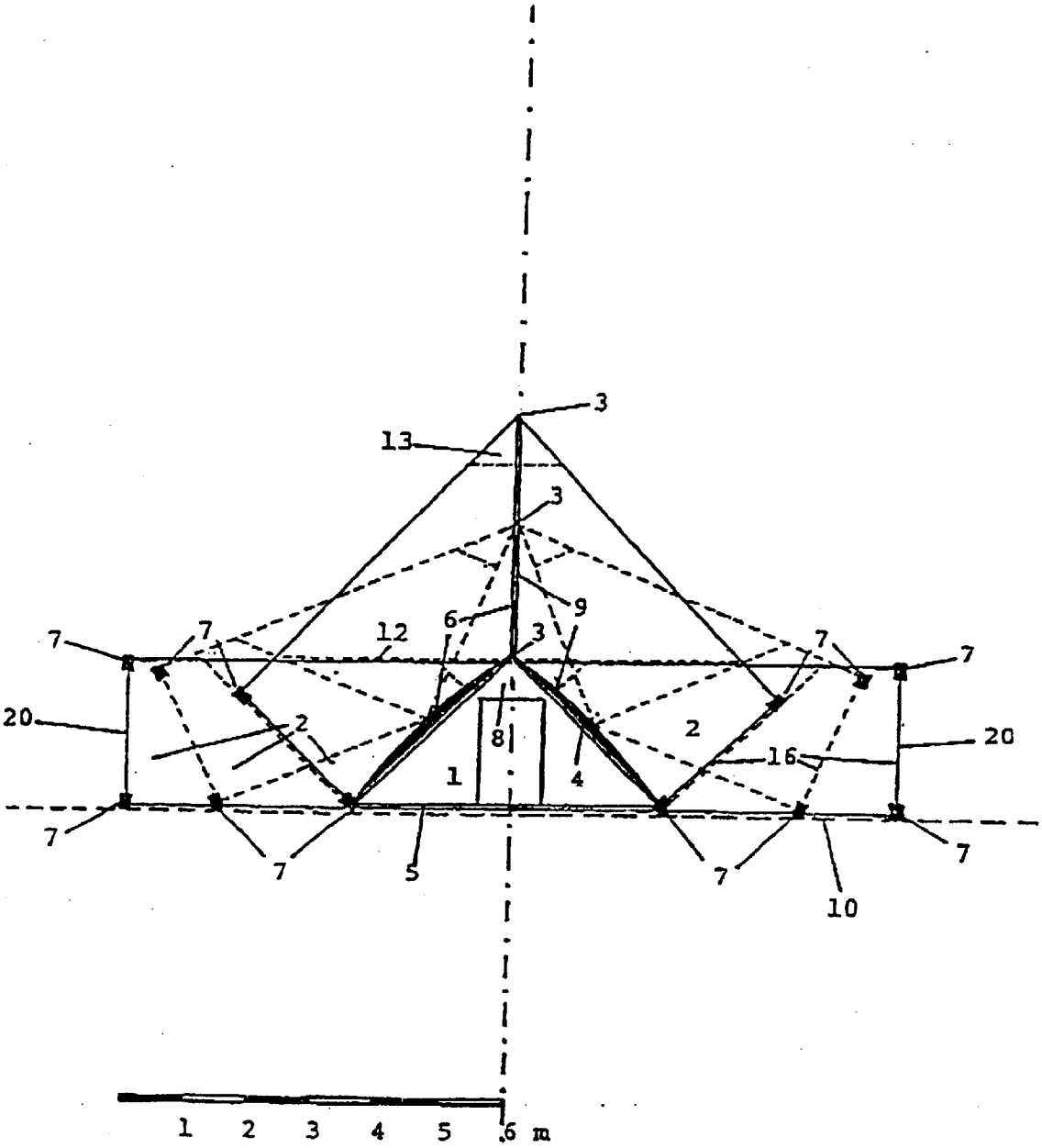
FIG. 19 shows, in broken lines, phases in the erection of the structural elements and in full lines, the transportation mode and the erected mode.

FIG. 8 is a perspective view of the two larger, erected three-dimensional parts above the prismatoidal central part, FIG. 9 shows three erected, connected large structural parts in perspective view;

FIG. 10 shows three erected, connected large structural parts with the recognisable two living planes; in perspective view, FIG. 11 shows five erected and connected large structural parts (a) above the gable sides, and (b) above one of the back sides in perspective view;

FIG. 12 is a view of an erected large structural part ready for connection, without showing the central part, with the guide rails on the reinforced frame, the latter being in particular for receiving the load for the transportation and construction phases;

FIG. 13 shows a facade design of an erected settlement prefabricated house consisting of three large structural parts with conventional door and window members;

FIG. 14 shows a facade design of an erected settlement prefabricated house consisting of three large structural parts with now panorama window members extending over two living planes;

FIG. 15 is a perspective view from the entrance to the reinforced frame of the prismatoidal central part with the larger three-dimensional parts erected thereabove, including stairs as well as a passage for a connection on the back side;

FIG. 16 is a perspective view of the large structural part connection side with reinforced central part and built-in stairs, FIG. 17 shows connected, erected large structural parts, seen from one back side, with incorporated stairs to the upper level passage to the back side connection as well as sanitary and kitchen fittings;

FIG. 18 shows large structural parts connected by way of the back sides, on prepared foundation points on a rising slope with the stairs to the respective upper floor sketched-in;

FIG. 19 shows phase sketches with recognisable contour variation from the transportation state=40 foot freight container to the double-storey settlement prefabricated house, protected with a ridge rood, including the guide rails on the legs of the prismatoidal central part.

What is claimed is:

1. A living space assembly for rapid erection, comprising:

a central substantially prism-like element;

a pair of rigid outer elements having a top face, a bottom face, two side faces, and two end faces;

the central prism-like element comprises a first face, a second face and a third face, all of which are parallel to a single axis, the first face forming a base, and the remaining two faces forming sides of the central prism-like element;

in a first transportable state, the pair of rigid outer elements are disposed symmetrically one each to each side of the central prism-like element, the corresponding outer elements having apices coincident with the apex of the central element and being shaped and arranged such that in the first transportable state the elements nest together to form a cuboid structure shaped and dimensioned to occupy substantially all the space in a standard freight container;

in a second erected state the apices of the outer elements are raised to form a roof ridge line, thereby completing the enclosure of the living space.

2. The assembly of claim 1, wherein the rigid outer elements have quadrilateral side faces with a sloping end face which nests against the corresponding diagonal side of the central element when in the first position.

3. The assembly of claim 1, wherein the outer elements are linked by a hinge device.

4. The assembly of claim 1, wherein each outer element has a base that is slideable on guide means provided on each side face of the central element.

5. The assembly of claim 4, wherein the guide means comprises a rail.

6. The assembly of claim 4, wherein the guide means is substantially convex.

7. The assembly of claim 4, wherein the guide means is substantially parabolic.

8. The assembly of claim 1, wherein the guide means incorporates a reinforcing member for supporting the outer elements during erection.

9. The assembly of claim 1, further comprising a second assembly assembled in combination to form a living space.

* * * * *